US009897406B2

(12) United States Patent
Oz et al.

(10) Patent No.: US 9,897,406 B2
(45) Date of Patent: Feb. 20, 2018

(54) UPGRADE KIT FOR ASSAULT RIFLE

(71) Applicant: CAA Industries Ltd., Kiryat Gat (IL)

(72) Inventors: Moshe Oz, Tel Aviv-Yafo (IL); Michael Ben Oren, Netanya (IL)

(73) Assignee: CAA Industries Ltd., Kiryat Gat (IL)

( * ) Notice: Subject to any disclaimer, the term of this patent is extended or adjusted under 35 U.S.C. 154(b) by 0 days.

(21) Appl. No.: 14/988,777

(22) Filed: Jan. 6, 2016

(65) Prior Publication Data

US 2017/0191773 A1 Jul. 6, 2017

(51) Int. Cl.

| | |
|---|---|
| ***F41A 11/02*** | (2006.01) |
| ***F41A 27/08*** | (2006.01) |
| ***F41G 11/00*** | (2006.01) |
| ***F41A 35/02*** | (2006.01) |
| ***F41A 35/06*** | (2006.01) |
| ***F41A 3/72*** | (2006.01) |

(52) U.S. Cl.

CPC ..... *F41A 11/02* (2013.01); *F41A 3/72* (2013.01); *F41A 27/08* (2013.01); *F41A 35/02* (2013.01); *F41A 35/06* (2013.01); *F41G 11/003* (2013.01)

(58) Field of Classification Search

CPC ..... F41A 3/72; F41A 7/00; F41A 7/02; F41A 9/34; F41A 9/37; F41A 9/39; F41A 35/06; F41G 11/003

USPC ..... 89/1.4, 1.42; 42/16, 85, 90, 124, 125, 42/127

See application file for complete search history.

(56) References Cited

U.S. PATENT DOCUMENTS

| | | | | | |
|---|---|---|---|---|---|
| 2,717,464 | A | * | 9/1955 | Marcati | F41A 3/82 42/16 |
| 3,404,480 | A | * | 10/1968 | Koucky | F41A 3/12 42/16 |
| 3,432,955 | A | * | 3/1969 | Vartanian | F41A 3/72 42/16 |
| 3,816,950 | A | * | 6/1974 | Vesamaa | F41A 3/72 42/16 |
| 4,702,144 | A | * | 10/1987 | Zedrosser | F41A 3/72 89/1.4 |
| 5,214,233 | A | * | 5/1993 | Weldle | F41A 3/72 89/1.4 |
| 5,606,825 | A | | 3/1997 | Olsen | |
| 6,019,024 | A | | 2/2000 | Robinson et al. | |

(Continued)

OTHER PUBLICATIONS

Internatioal Search Report for PCT Application No. PCT/IL2016/051356 dated Mar. 19, 2017.

*Primary Examiner* — Bret Hayes
(74) *Attorney, Agent, or Firm* — Pearl Cohen Zedek Latzer Baratz LLP

(57) ABSTRACT

An upgrade kit for an assault rifle, the rifle comprising a rear trunnion and a barrel, the kit comprising a mounting rail assembly adapted to provide steady and tight attachment to the barrel, an ambidextrous charging handle assembly adapted to be installed on the right or the left side of the rifle, at substantially the same location along the longitudinal axis. The charging handle assembly comprises a modified bolt carrier having a perforation, an installation rod having a first gap, and the installation rod corresponding in shape to the perforation in the bolt carrier. The charging handle is configured to be gripped by a user, and an intermediate section having a second gap, and connected to the installation rod and to the charging handle.

16 Claims, 11 Drawing Sheets

(56) References Cited

U.S. PATENT DOCUMENTS

| | | | | |
|---|---|---|---|---|
| 6,658,982 | B2 * | 12/2003 | Cherry | F41B 11/00 124/76 |
| 8,117,954 | B1 * | 2/2012 | Davis | F41A 3/72 42/71.01 |
| 8,539,871 | B1 | 9/2013 | Burt et al. | |
| 8,887,612 | B2 | 11/2014 | Bayly | |
| 8,899,138 | B2 | 12/2014 | Brown | |
| 8,985,007 | B2 | 3/2015 | Larson et al. | |
| 2008/0083319 | A1 * | 4/2008 | Richeson | F41A 3/72 89/1.4 |
| 2011/0271827 | A1 * | 11/2011 | Larson | F41A 5/28 89/193 |
| 2012/0102804 | A1 * | 5/2012 | Fesas | F41A 3/66 42/90 |
| 2012/0198990 | A1 * | 8/2012 | Brittin | F41A 5/26 89/191.01 |
| 2012/0260791 | A1 | 10/2012 | Kerbrat et al. | |
| 2015/0226501 | A1 * | 8/2015 | Gibbens | F41A 3/66 42/16 |
| 2015/0233656 | A1 | 8/2015 | Karagias | |

* cited by examiner

UPGRADE KIT FOR ASSAULT RIFLE

FIELD OF THE INVENTION

The present invention relates to firearms. More particularly, the present invention relates to kits and methods for upgrading assault rifles.

BACKGROUND OF THE INVENTION

An assault rifle is a selective-firearm, meaning that the user can select between semi-automatic and automatic firing modes. The assault rifle usually has firearm cartridges with a detachable magazine. Assault rifles were first used during World War II and, by the end of the 20th century, had become the standard service rifle for most of the world's armies.

Until today, different types of assault rifles have been produced over the years. However, the majority of users still prefer the "old" reliable rifles withstanding the test of time, such as the AK-47 (from 1947, manufactured by "Kalashnikov Concern") and the M16 (from 1957, manufactured by "Colt's Manufacturing Company") rifles. These firearms are designed for, and were proven to operate in, extreme harsh conditions and have therefore become so popular.

As the security challenges of the 21st century differ from the challenges of the 20th century, alongside with the vast technological developments, these "old" rifles are required to operate in rather new situations and conditions. For instance, some armies are interested in usage of reliable firearms, such as the AK-47, as well as using new technology such as infrared sights or grenade launcher assemblies.

Therefore, a need arises for a way to modify (or upgrade) the old existing assault rifles so as to create a new firearm that combines the long-tested reliability of the "old" weapon with steady combat operation including enhanced capabilities.

SUMMARY OF THE INVENTION

There is thus provided, in accordance with a preferred embodiment of the present invention, an upgrade kit for an assault rifle, the rifle comprising a rear trunnion and a barrel positioned along a longitudinal axis of the rifle is provided, the kit comprising: a mounting rail assembly, comprising a mounting platform that is configured to couple with rifle attachments, whereby the mounting rail assembly is adapted to provide steady and tight attachment to the barrel, an ambidextrous charging handle assembly adapted to be installed on the right or the left side of the rifle, at substantially the same location along the longitudinal axis, the charging handle assembly comprising: a modified bolt carrier having a perforation, and a press-fit pin, an installation rod having a first gap, and the installation rod corresponding in shape to the perforation in the bolt carrier, a charging handle configured to be gripped by a user, and an intermediate section having a second gap, and connected to the installation rod and to the charging handle, wherein the press-fit pin corresponds in shape to the first and second gaps, and wherein the press-fit pin is configured to removably connect the handle body to the bolt carrier.

Furthermore, in accordance with a preferred embodiment of the present invention, the mounting rail assembly further comprises a rear latch, configured to removably connect to the rear trunnion.

Furthermore, in accordance with a preferred embodiment of the present invention, the upgrade kit further comprises a locking latch, configured to be gripped by the user, wherein in a locked state the locking latch locks the mounting rail assembly to the rifle, and wherein operation of the locking latch removes the mounting rail assembly from the rifle.

Furthermore, in accordance with a preferred embodiment of the present invention, the movement of the locking latch from an open state to a locked state, snaps the locking latch onto at least one locking element, and aligns the locking latch with the barrel.

Furthermore, in accordance with a preferred embodiment of the present invention, the mounting rail is a Picattiny rail.

Furthermore, in accordance with a preferred embodiment of the present invention, the upgrade kit further comprises a handguard cover.

Furthermore, in accordance with a preferred embodiment of the present invention, the handguard cover comprises a bottom mounting platform that is configured to couple with rifle attachments.

Furthermore, in accordance with a preferred embodiment of the present invention, the upgrade kit further comprises a V-shaped attachment configured to align additional components onto the rifle, wherein the V-shaped attachment is further configured to allow contact with the barrel.

Furthermore, in accordance with a preferred embodiment of the present invention, the V-shaped attachment further comprises at least one V-shaped notch that is configured to tightly couple with a compatible portion of the top mounting rail assembly, and wherein the V-shaped notch is further configured to align the mounting rail assembly with the barrel along the longitudinal axis.

Furthermore, in accordance with a preferred embodiment of the present invention, a method for assembling a mounting rail assembly onto an assault rifle coupled with a locking latch, the rifle comprising a rear trunnion and a barrel positioned along a longitudinal axis of the rifle is provided, the method comprising providing a mounting rail assembly comprising a mounting platform that is configured to couple with rifle attachments, and a rear latch that is configured to removably connect to the rear trunnion, positioning the mounting rail assembly onto the barrel, along the longitudinal axis, such that the rear latch faces the rear trunnion, pushing the mounting rail assembly along the longitudinal axis, until the rear latch engages the rear trunnion and couples thereon, and moving the locking latch so as to snap at least one locking element of the rifle.

Furthermore, in accordance with a preferred embodiment of the present invention, the method further comprises moving the locking latch so as to snap off at least one locking element of the rifle, pushing the mounting rail assembly along the longitudinal axis, until the rear latch disengages the rear trunnion, and removing the mounting rail assembly from the rifle.

Furthermore, in accordance with a preferred embodiment of the present invention, a modified assault rifle is provided, comprising a barrel, positioned along a longitudinal axis of the rifle, a rear trunnion, a mounting rail assembly, comprising a mounting platform that is configured to couple with rifle attachments, whereby the mounting rail assembly is adapted to provide steady and tight attachment to the barrel, an ambidextrous charging handle assembly adapted to be installed on the right or the left side of the rifle, at substantially the same location along the longitudinal axis, the charging handle assembly comprising a modified bolt carrier having a perforation, and a press-fit pin; an installation rod having a first gap, and the installation rod corresponding in shape to the perforation in the bolt carrier, a charging handle configured to be gripped by a user; and an intermediate section having a second gap, and connected to the installation rod and to the charging handle, wherein the press-fit pin corresponds in shape to the first and second gaps, and wherein the press-fit pin is configured to removably connect the handle body to the bolt carrier.

Furthermore, in accordance with a preferred embodiment of the present invention, the mounting rail assembly further comprises a rear latch, configured to removably connect to the rear trunnion.

Furthermore, in accordance with a preferred embodiment of the present invention, the modified assault rifle further comprises a locking latch, configured to be gripped by the user, wherein in a locked state the locking latch locks the mounting rail assembly to the rifle, and wherein operation of the locking latch removes the mounting rail assembly from the rifle.

Furthermore, in accordance with a preferred embodiment of the present invention, the movement of the locking latch from an open state to a locked state, snaps the locking latch onto at least one locking element, and aligns the locking latch with the barrel.

Furthermore, in accordance with a preferred embodiment of the present invention, the mounting rail is a Picattiny rail.

Furthermore, in accordance with a preferred embodiment of the present invention, the modified assault rifle further comprises comprising a handguard cover.

Furthermore, in accordance with a preferred embodiment of the present invention, the handguard cover comprises a bottom mounting platform that is configured to couple with rifle attachments.

Furthermore, in accordance with a preferred embodiment of the present invention, the modified assault rifle further comprises a V-shaped attachment configured to align additional components onto the rifle, wherein the V-shaped attachment is further configured to allow contact with the barrel.

Furthermore, in accordance with a preferred embodiment of the present invention, the V-shaped attachment further comprises at least one V-shaped notch that is configured to tightly couple with a compatible portion of the top mounting rail assembly, and wherein the V-shaped notch is further configured to align the mounting rail assembly with the barrel along the longitudinal axis.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
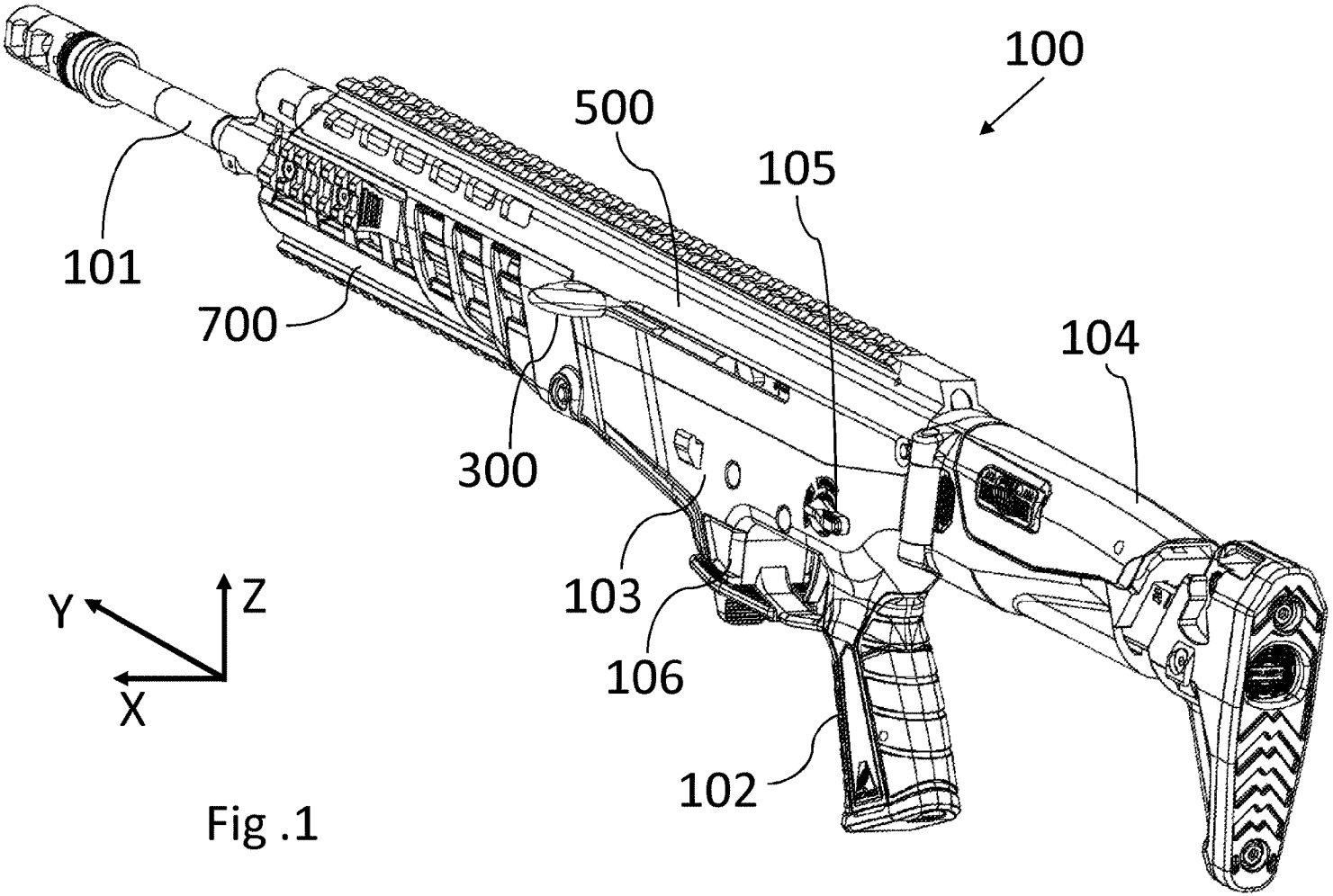
FIG. 1 schematically illustrates a perspective view of a modified assault rifle, according to an exemplary embodiment of the invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Reference is now made to FIG. 1, which schematically illustrates a perspective view of a modified assault rifle, generally designated 100, according to some embodiments of the invention. The modified assault rifle 100 may be created by assembling a dedicated upgrade kit onto an existing rifle so as to provide enhanced features for that rifle.

Alternatively, in some non-limiting embodiments, the modified assault rifle 100 may be provided as a complete unit (such that there is no need to assemble a kit onto the rifle), as further described hereinafter.

The basic assault rifle (prior to modifications) usually comprises a barrel 101, a gas tube and a bolt carrier (not shown in this drawing), all positioned along a longitudinal axis "Y" of the rifle. The basic assault rifle further comprises a pistol grip 102 at the bottom of the rifle's receiver 103, a buttstock 104 (for instance a foldable stock), and a fire mode selector lever 105 that allows the user to select the firing mode, i.e., for example between automatic, semi-automatic and safe modes. Additionally, the basic assault rifle may further comprise a trigger assembly 106, adapted to allow the user to squeeze the trigger and thereby fire a bullet/bullets from a compatible magazine.

Once additional upgrade elements are assembled onto the basic rifle, the modified assault rifle 100 may be created. These elements (for example provided with the dedicated upgrade kit) may comprise a top mounting rail assembly 500, a bottom handguard assembly 700, and also an ambidextrous charging handle assembly 300.

The modified assault rifle 100 may be equipped with the top mounting rail assembly 500 in order to allow mounting external components (for example electronic sights) onto a compatible mounting rail on top of the rifle, further described hereinafter. Similarly, the modified assault rifle 100 may be equipped with the bottom handguard assembly 700 in order to allow gripping the frontal part of the fired rifle that gets very hot, further described hereinafter. Thus, the basic rifle may be easily modified with enhanced features that are not possible, or that suffer of severe drawbacks, in the original basic rifle.

Additionally, the modified assault rifle 100 may be equipped with the ambidextrous charging handle assembly 300 so as to allow full operation of the rifle from the right or left side, as further described hereinafter. It is appreciated that such ambidextrous use may be particularly important during battle as both right-handed and left-handed operators may use the same weapon. In some non-limiting embodiments, the modified assault rifle 100 further comprises a second fire selector lever on the opposite side of the rifle (not shown in FIG. 1), and connected to the first fire selector, so as to allow the mode selection on either side of the rifle. Thus, total ambidextrous use may be achieved.

Figure 2A:
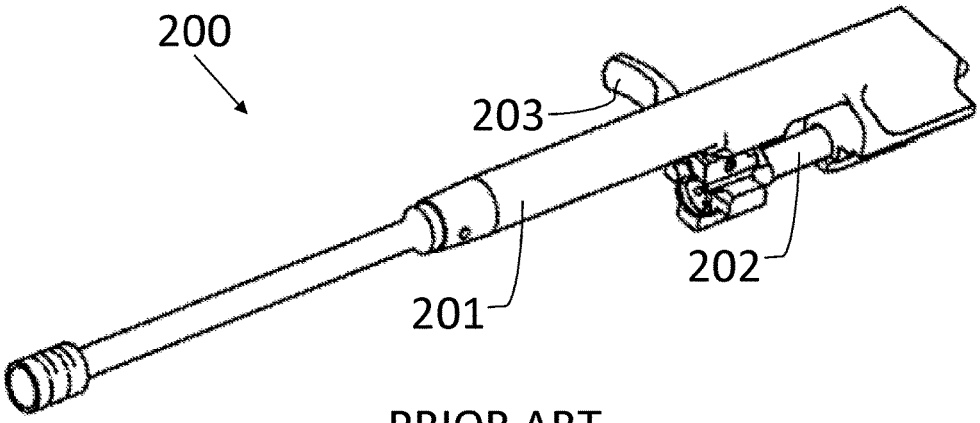
PRIOR ART Fig .2A
FIG. 2A schematically illustrates a perspective view of a commercially available bolt carrier coupled to a bolt.
Figure 2B:
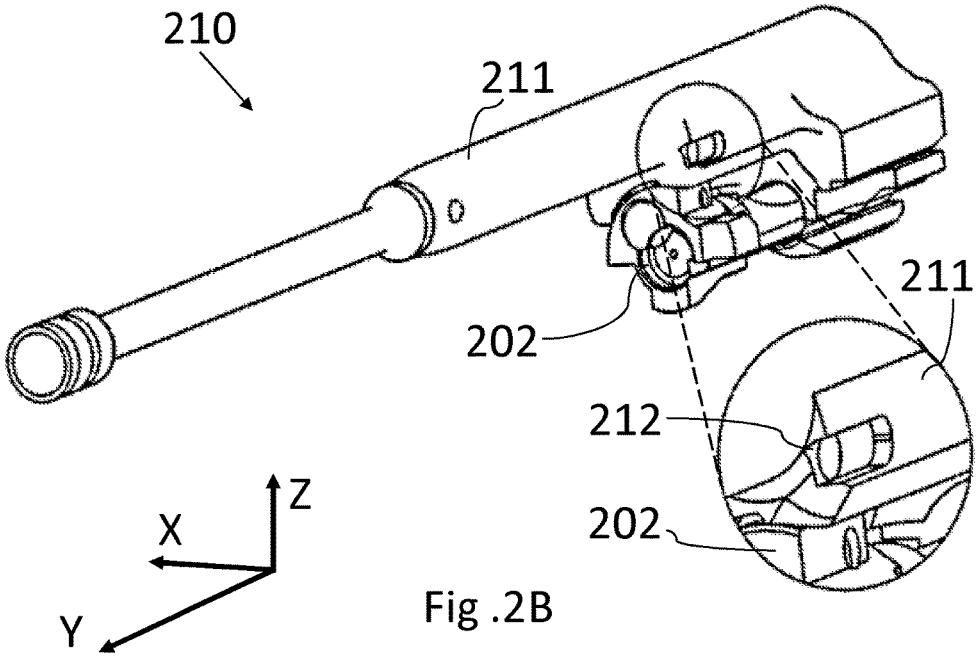
FIG. 2B schematically illustrates a perspective left side view of a modified bolt carrier coupled to a bolt, according to an exemplary embodiment of the invention.
Figure 2C:
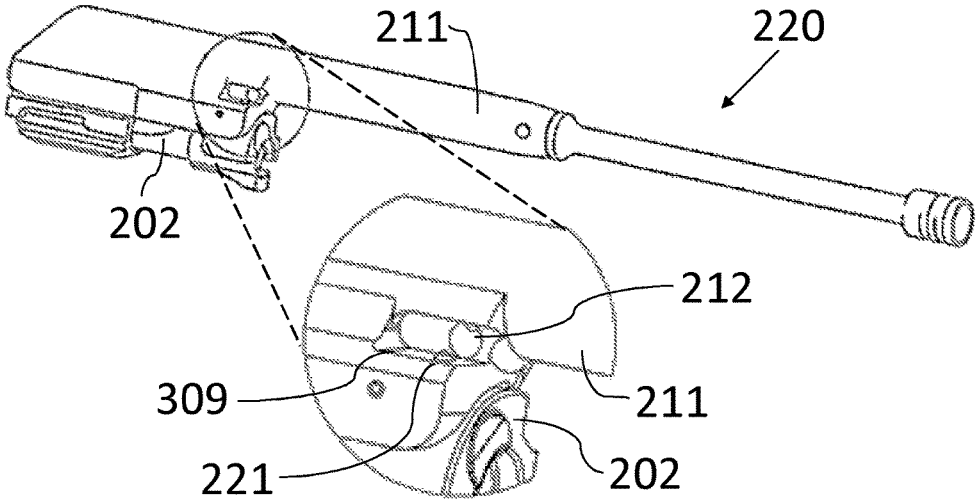
FIG. 2C schematically illustrates a perspective right side view of the modified bolt carrier coupled to a bolt, according to an exemplary embodiment of the invention.

Reference is now made to FIGS. 2A-2C, which show a commercially available bolt carrier and a modified bolt carrier coupled to a bolt. FIG. 2A schematically illustrates a perspective view of a commercially available bolt carrier coupled to a bolt, generally designated 200. The commercially available bolt carrier 201 is coupled to a bolt 202, wherein a charging handle 203 is structurally fixed to the bolt carrier 201. It is appreciated that, with this design, there is a need to provide separate bolt carriers (with corresponding charging handle) for right and left handed users, since the charging handle 203 is fixed to a particular side (right or left), right in the example of the drawing, of the bolt carrier 201. Moreover, due to structural constrains of the bolt carrier and the rifle's top cover of a commercially available rifle, installation of the charging handle on the other side of the bolt carrier (left in this case) may not be done at the same location along the longitudinal Y axis or the elevation Z axis of the bolt carrier.

FIG. 2B schematically illustrates a perspective left side view of a modified bolt carrier 211 coupled to a bolt 202 (with an enlarged section), generally designated 210, according to some embodiments of the invention. The modified bolt carrier 211 may be coupled with similar bolt 202 (as in the commercially available basic rifle), whereby the modification is carried out at the body of the modified bolt carrier 211 and also with a modified charging handle assembly, further described hereinafter.

Figure 3A:
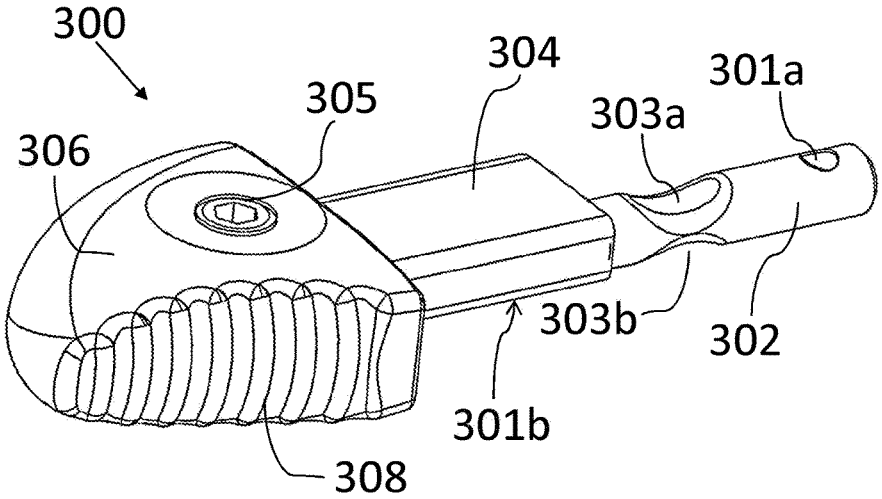
FIG. 3A schematically illustrates a perspective view of a modified charging handle assembly, according to an exemplary embodiment of the invention.

The modified bolt carrier 211 may be modified with a perforation 212 (e.g. cylindrical) passing from the left side to the right side, through the transverse axis "X". The modified charging handle assembly (for example as shown in FIG. 3A) may then be removably inserted and accommodated in that perforation 212 from either side of the bolt carrier 211 such that ambidextrous operation may be allowed.

It should be noted that the position of the perforation 212 on the modified bolt carrier 211 is particularly chosen for optimal performance, and therefore may provide a substantially stable connection with the modified charging handle assembly so as to allow ambidextrous use. Moreover, the position of the perforation 212 is very close to the position of the original commercially available charging handle (of the basic rifle) such that the position of the modified charging handle (once assembled) may correspond to the position of the charging handle on the rifle. Furthermore, it is appreciated that the perforation 212 is carried out in a position that has sufficient bulk material (of the bolt carrier) for perforating and yet provide sufficient mechanical support to the charging handle, thus keeping a substantially stable structure of the modified bolt carrier 211 while providing an opening for connection to the modified charging handle on both sides of the bolt carrier 211.

Since the charge handle according to the invention is adapted to be inserted into the perforation in the bolt carrier and is not made as part of it, there is no need to keep some material (typically steel) for a fixed charging handle. Thus, the bulk material required for manufacturing of such modified bolt carriers may be substantially smaller compared to bulk material required for manufacturing commercially available bolt carriers.

FIG. 2C schematically illustrates a perspective right side view of a modified bolt carrier coupled to a bolt (with an enlarged section), generally designated 220, according to some embodiments of the invention. It is appreciated that FIG. 2C shows the other end of the perforation 212 (as previously shown in FIG. 2B), on the right side of the modified bolt carrier 211. The modified charging handle may pass from the left side to the right side (or vice versa) through the perforation 212 in order to connect with the bolt carrier 211, as further described hereinafter.

The modified bolt carrier 211 may be further adapted to secure the position of the modified charging handle once it is inserted through the perforation 212. In some non-limiting embodiments, the modified bolt carrier 211 comprises a press-fit pin 221 (partially shown in FIG. 2C) that is partially housed inside the bolt carrier 211 such that only the top portion protrudes towards the perforation 212. For example, a spring operated press-fit ball plunger may be employed, whereby a physical element that is adapted to apply force onto the top portion to be inserted into the bolt carrier 211 may cause the spring to contract and later release the accumulated energy.

Figure 3B:
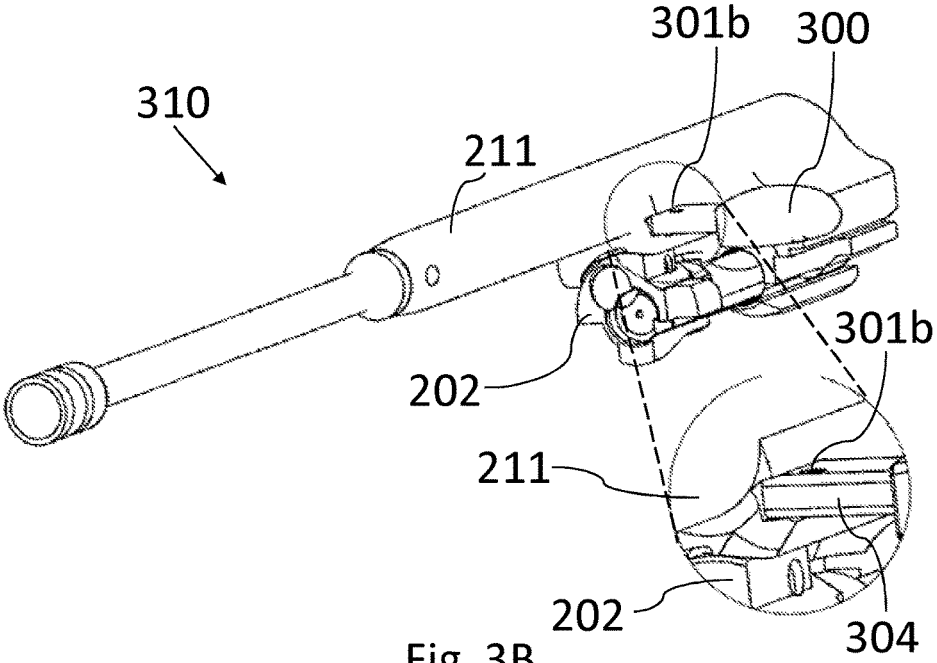
FIG. 3B schematically illustrates a perspective left side view of the modified bolt carrier coupled to the bolt and to the modified charging handle assembly, according to an exemplary embodiment of the invention.
Figure 3C:
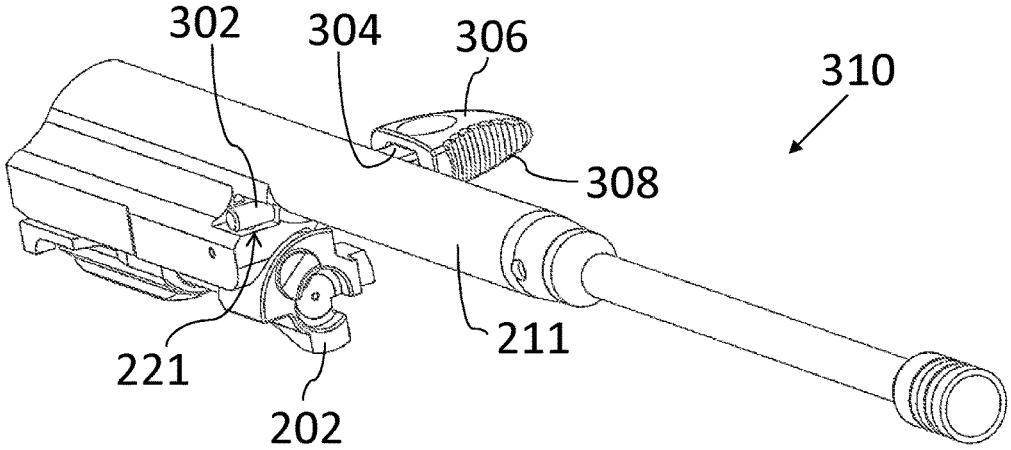
FIG. 3C schematically illustrates a perspective right side view of the modified bolt carrier coupled to the bolt and to the modified charging handle assembly, according to an exemplary embodiment of the invention.

Reference is now made to FIGS. 3A-3C, which show a modified charging handle assembly alone, and coupled to the modified bolt carrier, respectively. FIG. 3A schematically illustrates a perspective view of a modified charging handle assembly, generally designated 300, according to some embodiments of the invention. It is appreciated that the modified charging handle assembly 300 has a sufficiently symmetric structure in order to allow ambidextrous operation, from either side of the rifle.

The modified charging handle assembly 300 comprises a charging handle installation rod 302 that is configured to be removably inserted into the perforation 212 (for instance as shown in FIG. 2C), a charging handle 306, and an intermediate section 304 between the installation rod 302 and the charging handle 306. In some embodiments, the installation rod 302 is at least partially cylindrical.

The installation rod 302 may comprise a first concave gap 301*a*, on a first side of the modified charging handle assembly 300, this gap having a structure that corresponds to the press-fit pin 221 (for instance as shown in FIG. 2C). Therefore, when the installation rod 302 is inserted into the perforation 212, the press-fit pin 221 may then snap-fit into the first concave gap 301*a*, forced by its spring, into the space of this gap. The installation rod 302 may further comprise a first indentation 303*a*, on the first side, and a second indentation 303*b*, on the opposite second side of the modified charging handle assembly 300. The first and second indentations 303*a*, 303*b* are configured to engage, each at its corresponding installation side (right or left), other elements of the rifle within the bolt carrier (for example engaging the recoil spring), as further described in FIG. 4B. It should be noted that if the installation rod 302 is inserted into the perforation 212, a portion of the intermediate section 304 and charging handle 306 remain on the outer side of the bolt carrier, further described hereinafter. Optionally, a portion of the intermediate section 304 may be accommodated inside the bolt carrier 211, thereby providing further stability to the charging handle.

The intermediate section 304 may comprise a second concave gap 301*b* (for instance shown in FIG. 3B), on the second side of the charging handle assembly 300, whereby the second concave gap 301*b* has similar structure and purpose as the first concave gap 301*a*. The reason that both of these gaps are required is that a symmetrical charging handle is optimal for ambidextrous operation.

In case that the charging handle assembly 300 is inserted into the perforation 212 through the right side of the rifle, the second concave gap 301*b* may engage the press-fit pin 221. Alternatively, in case that the charging handle assembly 300 is inserted into the perforation 212 through the left side of the rifle, the first concave gap 301*a* may engage the press-fit pin 221 (for instance as shown in FIG. 4B).

In some embodiments, the size of the intermediate section 304 may be substantially larger than the size of the installation rod 302, in order to provide enhanced stability to the charging handle assembly 300. The enhanced stability may be provided when the intermediate section 304 engages a shelf 309 of the bolt carrier 211 (as shown in FIGS. 2C and 4B) so that a force applied for pulling or pushing the charging handle 306 does not transfer only to the installation rod 302 (inside the perforation) but rather on the intermediate section 304 that partially "rests" on the shelf 309 supporting the intermediate section 304.

The charging handle 306 may comprise a socket 305 configured to house a compatible fastening means, such as screws connecting the charging handle 306 to the intermediate section 304. The charging handle 306 may further comprise at least one gripping portion 308 that is configured to allow a user to grip and pull the charging handle (once assembled) in order to recharge the rifle.

FIG. 3B schematically illustrates a perspective left side view of the modified bolt carrier 211 coupled to the bolt 202 and to the modified charging handle assembly 300 (with an enlarged section), generally designated 310, according to some embodiments of the invention. It is appreciated that the modified charging handle assembly 300 is coupled with the bolt carrier 211 such that that only the intermediate section 304 and charging handle are protruding, while the installation rod is within the perforation.

FIG. 3C schematically illustrates a perspective right side view of the modified bolt carrier 211 coupled to the bolt 202 and to the modified charging handle assembly 300 (with an enlarged section), according to some embodiments of the invention. It should be noted that the charging handle assembly 300 is inserted from the left side such that the installation rod 302 protrudes from the right side in order to engage the press-fit pin 221.

Figure 4A:
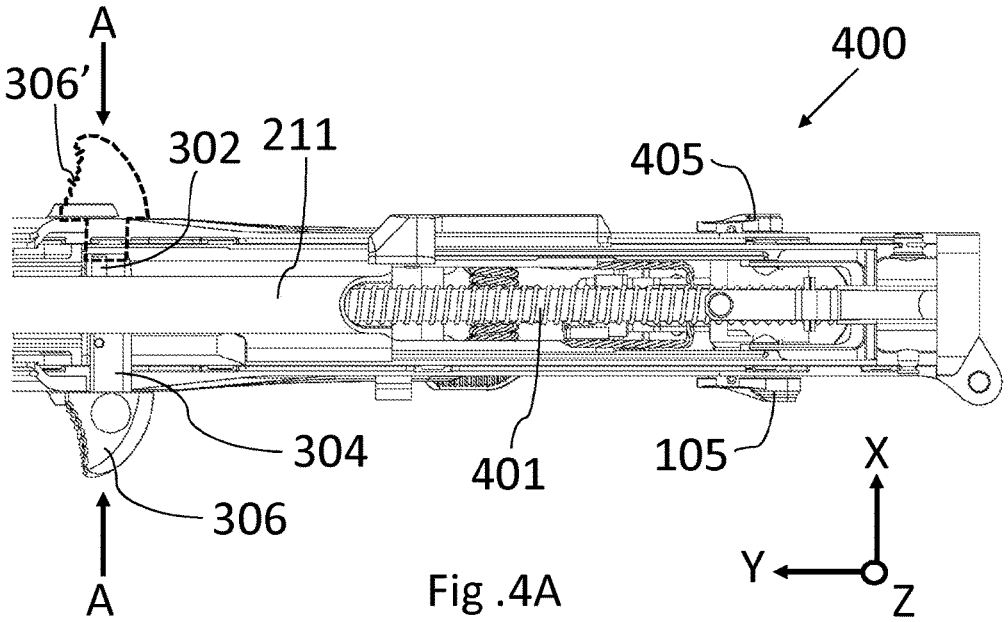
FIG. 4A schematically illustrates a partial top view of the modified charging handle assembly coupled to the rifle, according to an exemplary embodiment of the invention.
Figure 4B:
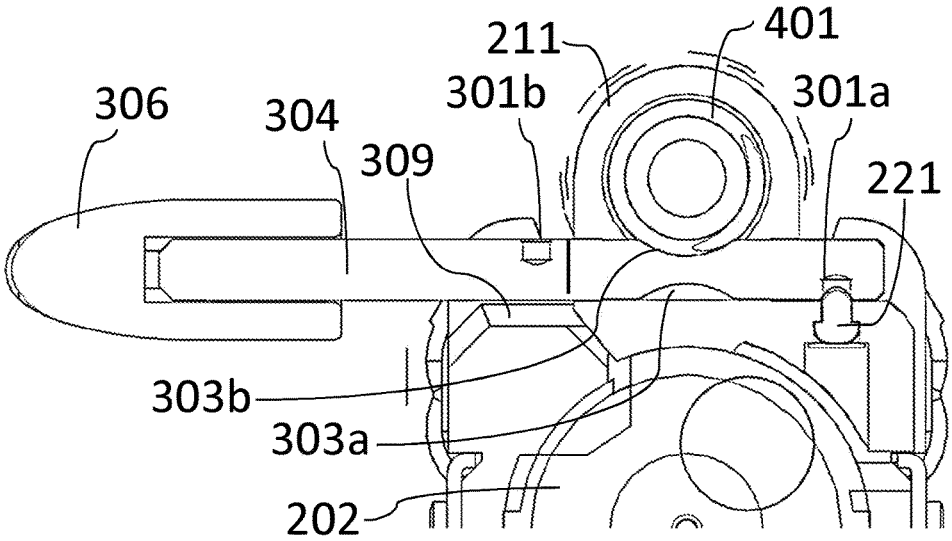
FIG. 4B schematically illustrates a partial cross-sectional view of the modified charging handle assembly coupled to the rifle, according to an exemplary embodiment of the invention.

Reference is now made to FIGS. 4A-4B, which show the modified charging handle assembly coupled to the rifle. FIG. 4A schematically illustrates a partial top view of the modified charging handle assembly coupled to the rifle, generally designated 400, according to some embodiments of the invention. It is appreciated that the modified charging handle assembly may be coupled with the rifle such that ambidextrous operation is provided, whereby the user may assemble the charging handle assembly either on the right or left side of the rifle. Furthermore, it should be noted that, while the charging handle assembly may be assembled on different sides of the rifle, the positioning of the perforation causes the charging handle to be located on the same position along the longitudinal axis "Y", whether the right or left sides are chosen. It should be noted that a dashed line indicates the position of the charging handle (numbered 306') if it was inserted from the right side, wherein the position of the charging handle remains on the same location along the longitudinal axis "Z".

The user may easily remove the charging handle from a certain side, right or left, where it is coupled to the rifle, and place it on the opposite side. For example, a soldier at the battlefield may take a typical bullet (from the compatible magazine) to push the charging handle assembly against fastening force applied by the press-fit pin, such that the charging handle may be removed from the perforation and then inserted through the opposite side of the perforation. Thus, there is no need to keep some left handed and some right handed firearms, as the modified charging handle assembly allows the rifle to be used as a left-handed or right-handed charging action rifle, as may be needed. In some embodiments, upon engagement with the press-fit pin, the position of the charging handle is secured.

As mentioned above, in some embodiments the modified rifle may comprise a second fire selector lever 405 (in addition to the first lever 105) therefore providing ambidextrous operation since the user may use the charging handle and the fire selector lever either on the left side or on the right side on the same modified rifle.

Other elements of the basic rifle (as shown in FIG. 4A) may include a recoil spring 401 that is compatible with the bolt carrier 211. The recoil spring 401 may be configured to push forward the bolt carrier 211 after firing, wherein the gas released from the firing pushing the bolt carrier backwards.

FIG. 4B schematically illustrates a partial cross-sectional view of the modified charging handle assembly coupled to the rifle, wherein the cross-section is along the A-A line shown in FIG. 4A, according to some embodiments of the invention. It is appreciated that in the case that the charging handle assembly 300 is inserted into the perforation 212 through the left side of the rifle (as shown in FIGS. 4A-4B), the first indentation 303*a* engages the recoil spring 401 placed thereupon after assembly. Thus, the recoil spring 401 may freely move along the longitudinal axis "Y" of the rifle such that friction with the installation rod is reduced and does not disturb the operation of the rifle.

It should be noted that, in the opposite case that the charging handle assembly is inserted into the perforation through the right side of the rifle, the second indentation 303*b* may engage the recoil spring 401.

Furthermore, it is appreciated that the first concave gap 301*a* engages the press-fit pin 221 (accommodated therein) in the case that the charging handle assembly is inserted into the perforation through the left side of the rifle. In the opposite case that the charging handle assembly is inserted into the perforation through the right side of the rifle, the second concave gap 301*b* may engage the press-fit pin 221 (accommodated therein).

Figure 5A:
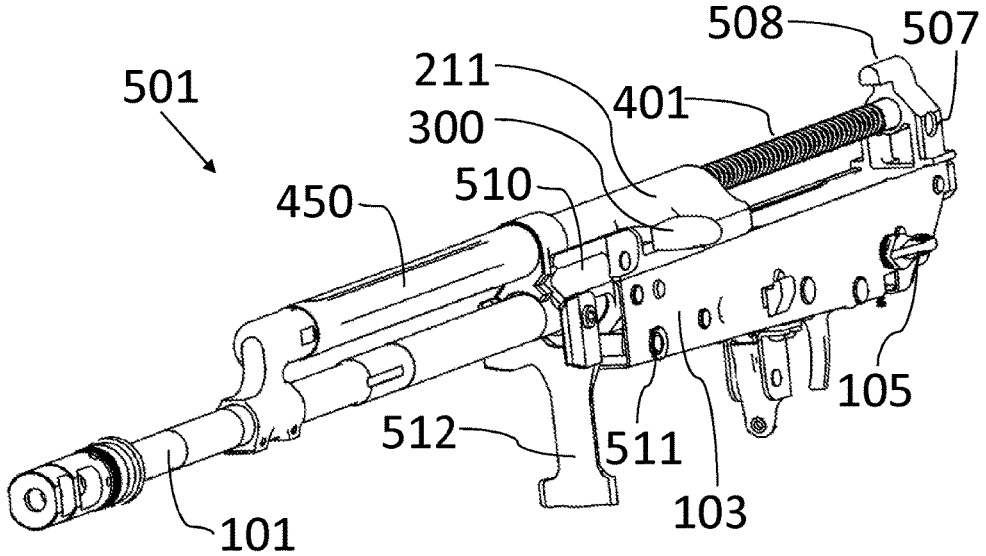
FIG. 5A schematically illustrates a perspective view of the modified rifle prior to engagement with a top mounting rail assembly, according to an exemplary embodiment of the invention.

Reference is now made to FIGS. 5A-5G, which show the assembling of the top mounting rail assembly onto the rifle. It is appreciated that for illustrative purposes and enhanced clarity, the trigger assembly and pistol grip are not shown in these figures. FIG. 5A schematically illustrates a perspective view of the modified rifle prior to engagement with the top mounting rail assembly, generally designated 501, according to some embodiments of the invention.

Figure 5B:
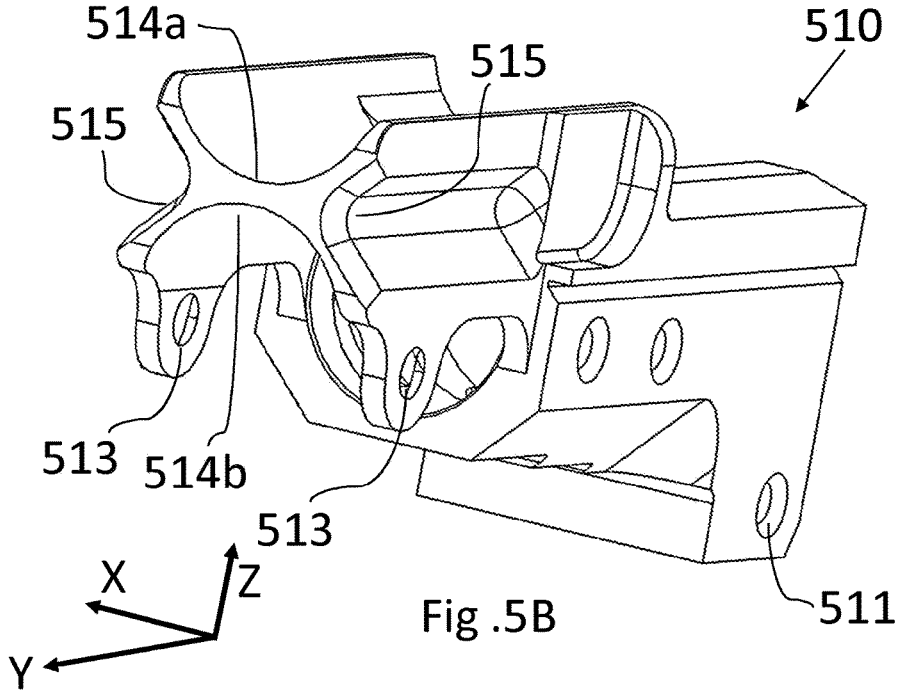
FIG. 5B schematically illustrates a perspective view of a V-shaped attachment, according to an exemplary embodiment of the invention.
Figure 5C:
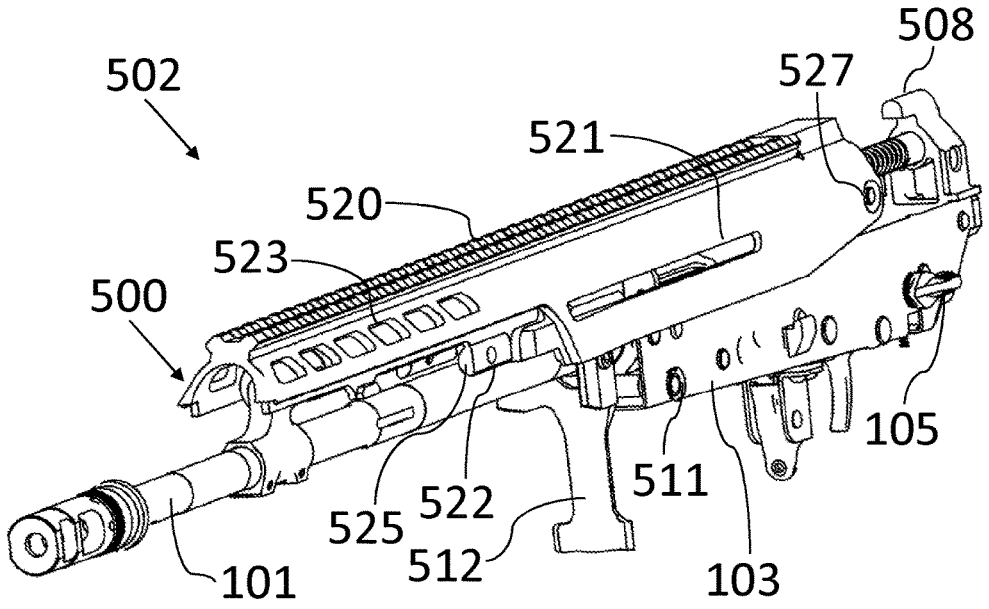
FIG. 5C schematically illustrates a perspective left-side view of the modified rifle during engagement with the top mounting rail assembly, according to an exemplary embodiment of the invention.

It should be noted that the rifle illustrated in FIG. 5A is a modified rifle (for instance a modified AK-47) that is compatible with the top mounting rail assembly 500 (for example as shown in FIG. 5C). Specifically, the basic rifle may be provided with compatible components such as a rear trunnion 508 (a protrusion used as a mounting and/or pivoting point) or a V-shaped attachment 510 that are configured to allow connection to the top mounting rail assembly 500 in order to create the modified rifle onto which the mounting rail assembly 500 may be assembled. Optionally, the modified rifle (as shown in FIG. 1) may be provided as a complete unit. In other embodiments, such compatible components may be provided separately (for instance in a kit) and later assembled onto the rifle.

Optionally, the modified rifle may further have a rear coupling element 507 and top coupling element 513 (shown in FIG. 5B) that are configured to allow coupling the top mounting rail assembly 500 to the rifle, and also a bottom coupling element 511 that is configured to allow coupling the bottom handguard assembly 700 (for example as shown in FIG. 7) to the rifle. Such coupling elements may be for example apertures in the rifle's receiver 103 that are capable of coupling with a dedicated pin.

Furthermore, the modified rifle may comprise a locking latch 512, which is configured to be gripped and allow the user to initiate quick release (or alternatively quick locking) of the top mounting rail assembly. It is appreciated that the locking latch 512 may be assembled onto the basic rifle (i.e., to create the modified rifle) or alternatively provided already assembled on a modified rifle prior to mounting of the top mounting rail assembly, as further described hereinafter.

FIG. 5B schematically illustrates a perspective view of the V-shaped attachment 510, according to some embodiments of the invention. The V-shaped attachment 510 may be assembled along the longitudinal axis "Y" of the rifle as a central component of the rifle that is configured to accurately align the additional components that may be assembled onto the rifle (to create the modified rifle). For such alignment, the V-shaped attachment 510 may have a channel rotated 90° degrees relative to the transverse axis "X". The V-shaped attachment 510 may comprise a top concave surface 514*a* that is adapted to contact the gas tube cover 450 (shown in FIG. 5A), and also a bottom concave surface 514*b* that is adapted to contact the barrel 101 of the modified rifle.

In some embodiments, the V-shaped attachment 510 further comprises at least one V-shaped notch 515 that is configured to tightly couple with a compatible portion of the top mounting rail assembly 500, thus aligning the top mounting rail assembly 500 with the rifle's barrel along the longitudinal axis "Y".

FIG. 5C schematically illustrates a perspective left-side view of the modified rifle during engagement with the top mounting rail assembly, generally designated 502, according to some embodiments of the invention. The user may couple the rifle with the top mounting rail assembly 500, by sliding alignment elements 525 through the V-shaped notch 515 of the V-shaped attachment 510 such that the top mounting rail assembly 500 may be tightly attached and securely aligned with the barrel 101 of the rifle (i.e., with the longitudinal axis).

Figure 5D:
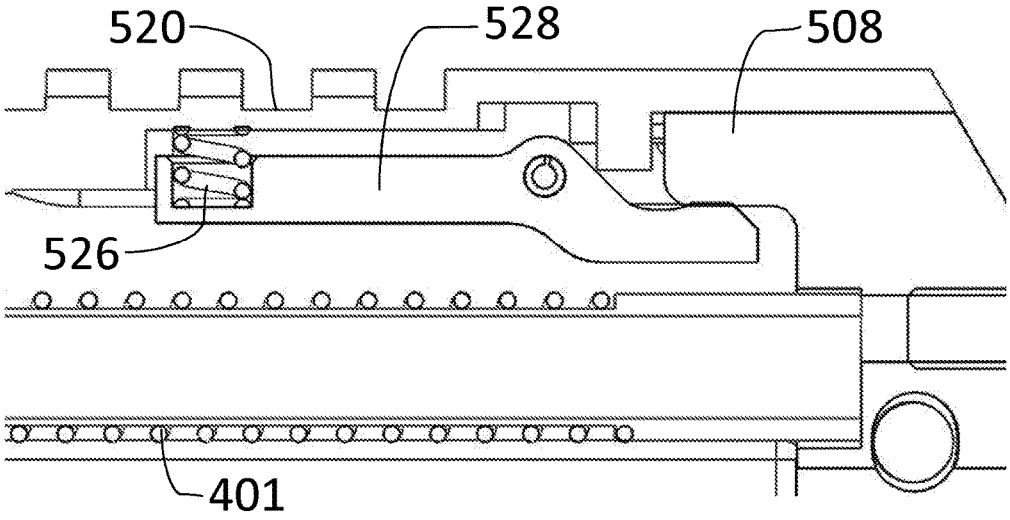
FIG. 5D schematically illustrates a partial cross-sectional view of the top mounting rail assembly assembled onto the rifle, according to an exemplary embodiment of the invention.

Thus, the user may slide the top mounting rail assembly 500 backwards with respect to the shooting direction to engage the rear trunnion 508 in order to secure the position of the rear portion of the top mounting rail assembly 500 with a rear latch, whereby the securing (or locking) mechanism of the top mounting rail assembly 500 is further described in FIG. 5D.

In some non-limiting embodiments, the top mounting rail assembly 500 may comprise at least one side slot 521 that may serve as an ejection port (for ejection of cartridges during firing) on a first side as well as a passage for the charging handle 300 on the opposite side (for example as shown in FIG. 1). Thus, while assembling the top mounting rail assembly 500 onto the rifle, the user may pass the charging handle 300 through the corresponding slot 521, and slide the top mounting rail assembly 500 backwards to engage the rear trunnion 508.

The top mounting rail assembly 500 may further comprise a mounting rail platform 520 (e.g., Picattiny rail) that is configured to allow coupling the rifle with external mountable components. For instance, assembling a laser sight onto the mounting rail platform 520.

In some non-limiting embodiments, the top mounting rail assembly 500 may further comprise a plurality of openings 523 that are adapted to allow heat extraction from the gas tube within. Optionally, the top mounting rail assembly 500 has mounting rail rear coupling element 527 that corresponds to the rifle's rear coupling element 507 (as shown in FIG. 5A), such that insertion of a compatible locking pin through elements 527 and 507 may secure the top mounting rail assembly 500 to the rifle.

It is appreciated that the assembling of the top mounting rail assembly 500 onto the rifle with the sliding of the alignment elements 525 through the V-shaped notches 515 (further described in FIG. 5G) may provide accurate and stable positioning of the mounting rail platform 520. Thus, any component mounted onto the mounting rail platform 520 may be accordingly accurately aligned and stable respectively.

In some embodiments, the top mounting rail assembly 500 may further comprise at least one locking element 522 that is configured to connect with the locking latch 512, further described hereinafter.

Figure 5E:
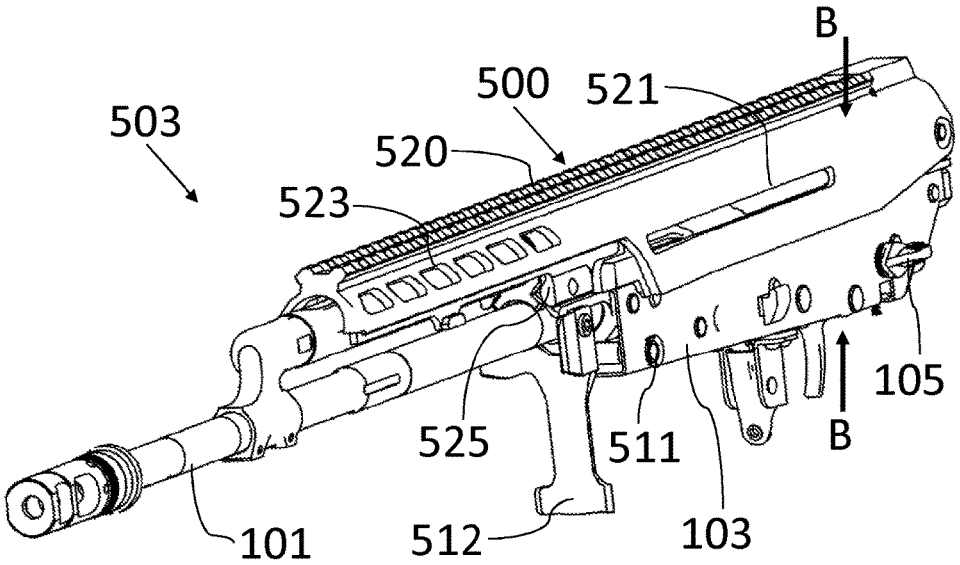
FIG. 5E schematically illustrates a perspective left-side view of the top mounting rail assembly assembled onto the modified rifle, according to an exemplary embodiment of the invention.

FIG. 5D schematically illustrates a partial cross-sectional view of the top mounting rail assembly assembled onto the rifle wherein the cross-section is along the B-B line shown in FIG. 5E, according to some embodiments of the invention.

The top mounting rail assembly may comprise a rear latch 528 that corresponds to the rear trunnion 508 of the rifle. The rear latch 528 may be pivotally connected to the mounting rail platform 520 with an elastic element 526 (e.g. a spring) that is configured to allow the rear latch 528 to be aligned with the rear trunnion 508 by being tightly attached to it. Specifically, when the user pushes the top mounting rail assembly backwards towards the rear trunnion 508, the rear latch 528 may engage the rear trunnion 508 and accordingly adjust the height of the mounting rail platform 520 with respect to the barrel longitudinal direction. It is appreciated that the rear latch 528 "cages" the rear trunnion 508 so as to ensure tight and aligned mounting of the mounting rail platform 520 to the rifle.

FIG. 5E schematically illustrates a perspective left-side view of the top mounting rail assembly assembled onto the modified rifle, generally designated 503, according to some embodiments of the invention. It is appreciated that with the top mounting rail assembly 503 assembled onto the modified rifle, the gas tube (also covered by the top mounting rail assembly) may be aligned and optionally fixed with the mounting rail platform 520, such that the accuracy of the rifle is not reduced.

It should be noted that, at this state, the top mounting rail assembly 500 may be fixed to the rifle with the dedicated locking pin inserted into rear coupling element 507. In order to fix the frontal portion of the top mounting rail assembly 500, additional locking may be required with the locking latch 512.

Figure 5F:
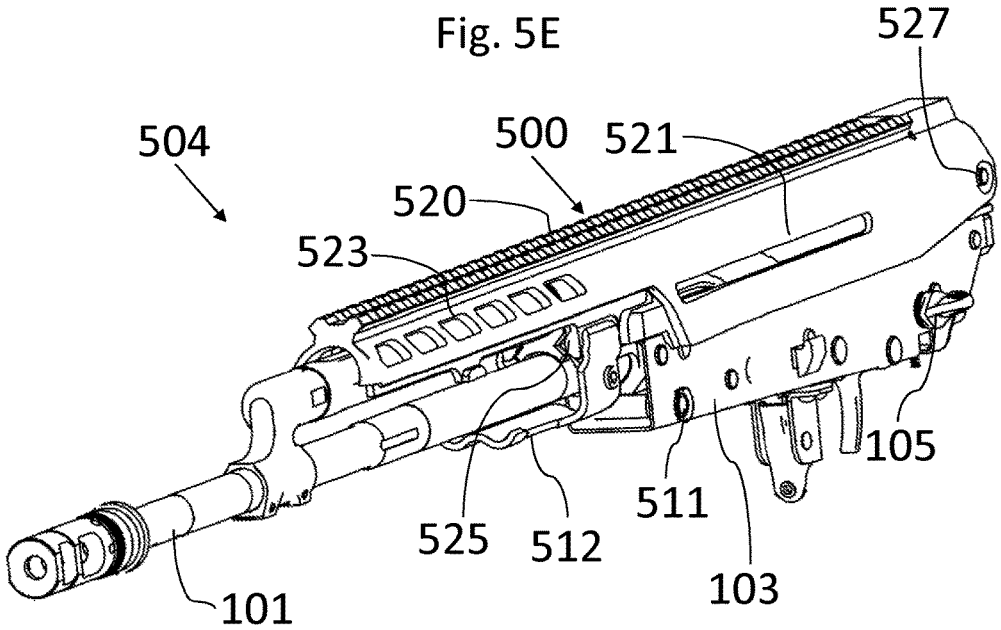
FIG. 5F schematically illustrates a perspective left-side view of the top mounting rail assembly assembled onto the modified rifle and locked with a locking latch, according to an exemplary embodiment of the invention.
Figure 5G:
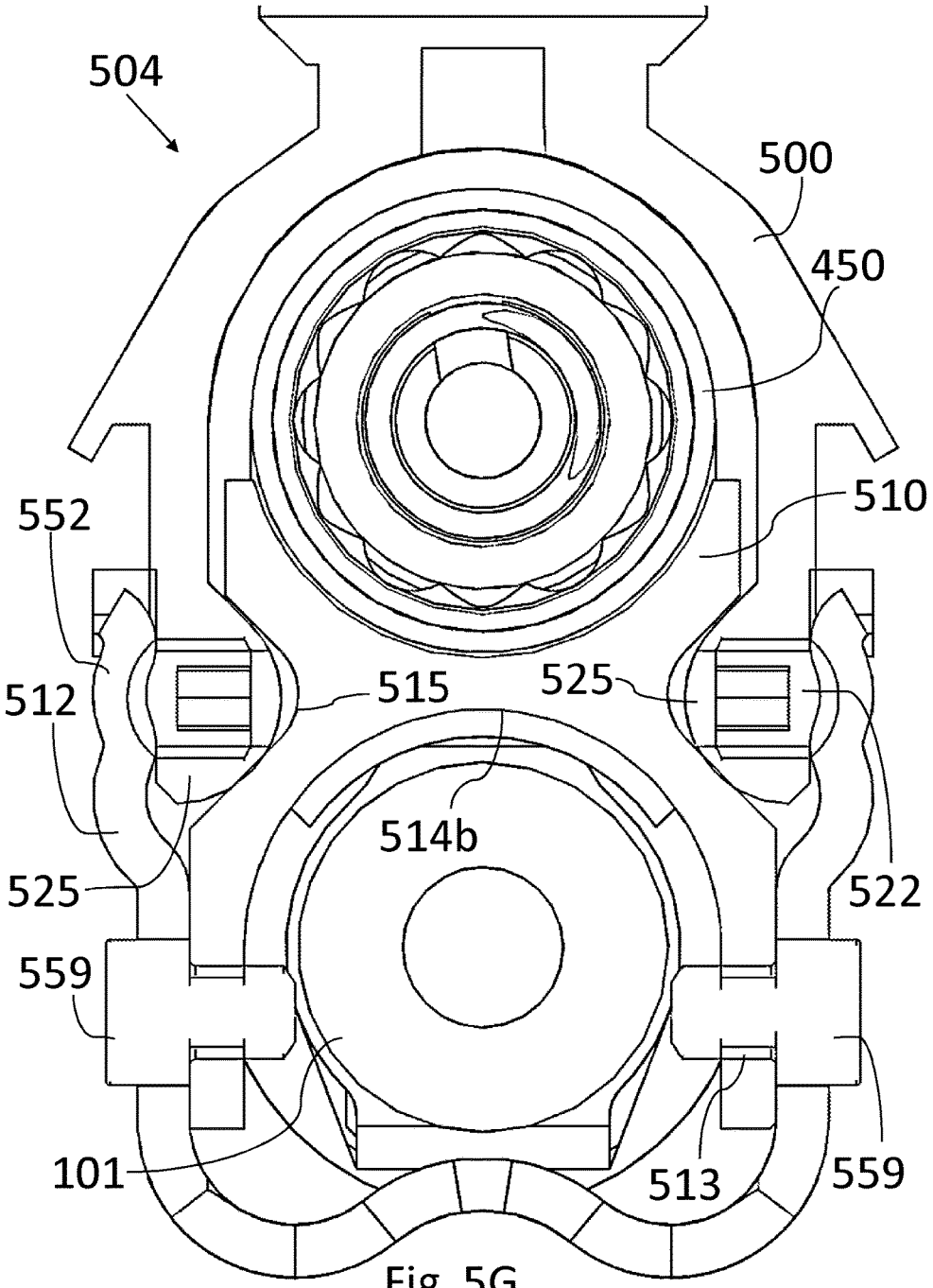
FIG. 5G schematically illustrates a cross-sectional view of the top mounting rail assembly assembled onto the modified rifle and locked with a locking latch, according to an exemplary embodiment of the invention.

FIG. 5F schematically illustrates a perspective left-side view of the top mounting rail assembly assembled onto the modified rifle and locked with a locking latch, generally designated 504, according to some embodiments of the invention.

The user may move the locking latch 512 pivotally upward towards the barrel 101, so as to align the locking latch 512 with the barrel 101 and lock the frontal portion of the top mounting rail assembly 500 to the rifle. Thus, the modified rifle is in a locked state.

The pivotal movement of the locking latch 512 upwardly may tightly snap latch 512 onto the at least one locking element 522 (on the top mounting rail assembly 500) such that the locking element 522 may be tightened to removably affix the position and orientation of the top mounting rail assembly 500 with the applied pressure from the snap. The engagement of the locking latch 512 with the locking element 522 is further described in FIG. 5G.

In some embodiments, the locking latch 512 may also provide a quick release. From a locked state, the user may grip and pull downward the locking latch 512 so as to release the lock (from locking elements 522) and then remove the top mounting rail assembly 500 by sliding it forward. Thus, quick dismantling may be achieved, in contrast to commercially available rifles where several parts need to be dismantled in order to be able remove the top cover of the rifle.

It is appreciated that with the top mounting rail assembly 500 assembled onto the rifle, various brackets and/or bumps are covered such that the user may only contact a smooth surface.

FIG. 5F schematically illustrates a cross-sectional view of the top mounting rail assembly assembled onto the modified rifle and locked with a locking latch, wherein the cross-section is along the traverse line of the locking elements 522. At the state where the locking latch is locked, the locking lips 552 of the locking latch 512 may snap onto the elastic locking elements 522 so as to press and lock the top mounting rail assembly 500 onto the V-block attachment 510 so as to press and lock the top mounting rail assembly 500 onto the V-block attachment 510 and thereby lock onto the rifle.

It is appreciated that the alignment of the top mounting rail assembly 500 to the barrel 101 may occur due to the sliding of the alignment elements 525 along the V-shaped notches 515. In some embodiments, the locking latch may pivotally move with a dedicated pivoting pin 559 inserted into the top coupling element 513.

Figure 6A:
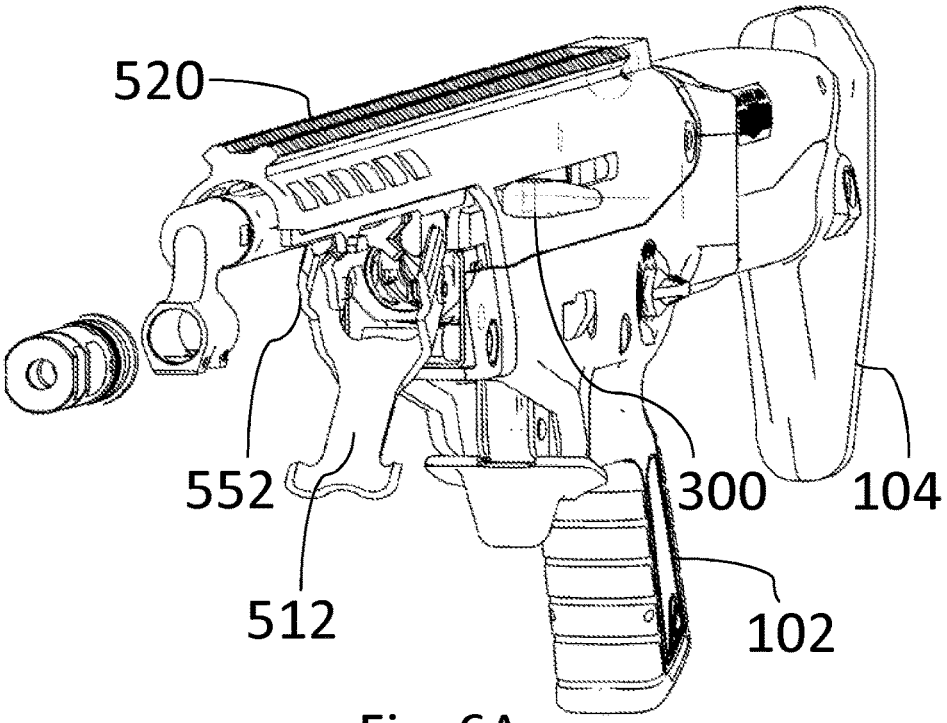
FIG. 6A schematically illustrates a perspective left-side view of the top mounting rail assembly assembled onto the modified rifle in an open state, according to an exemplary embodiment of the invention.
Figure 6B:
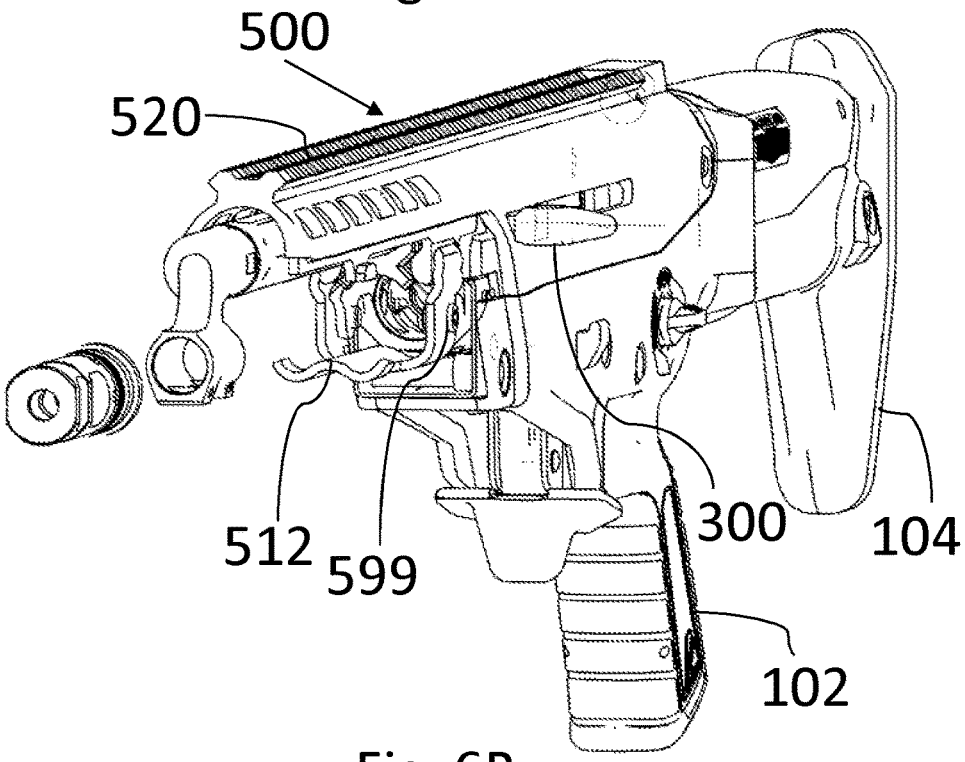
FIG. 6B schematically illustrates a perspective left-side view of the top mounting rail assembly assembled onto the modified rifle in a closed state, according to an exemplary embodiment of the invention.

Reference is now made to FIGS. 6A-6B, which show two positions of the locking latch 512, in open (released) position and in close (locked) position, respectively. It is appreciated that, for illustrative purposes and enhanced clarity, the barrel is not shown in these figures. FIG. 6A schematically illustrates a perspective left-side view of the top mounting rail assembly 500 assembled onto the modified rifle in an open state, and FIG. 6B schematically illustrates the same in a locked state. As is shown in FIG. 6B when locking latch 512 is in "close" position locking lips 552 of locking latch 512 apply pressure onto locking elements 522, thereby tightening them onto notches 515 (shown in FIG. 5G) to provide tightly aligned affixing of top mounting rail assembly 500 onto the rifle.

Figure 7A:
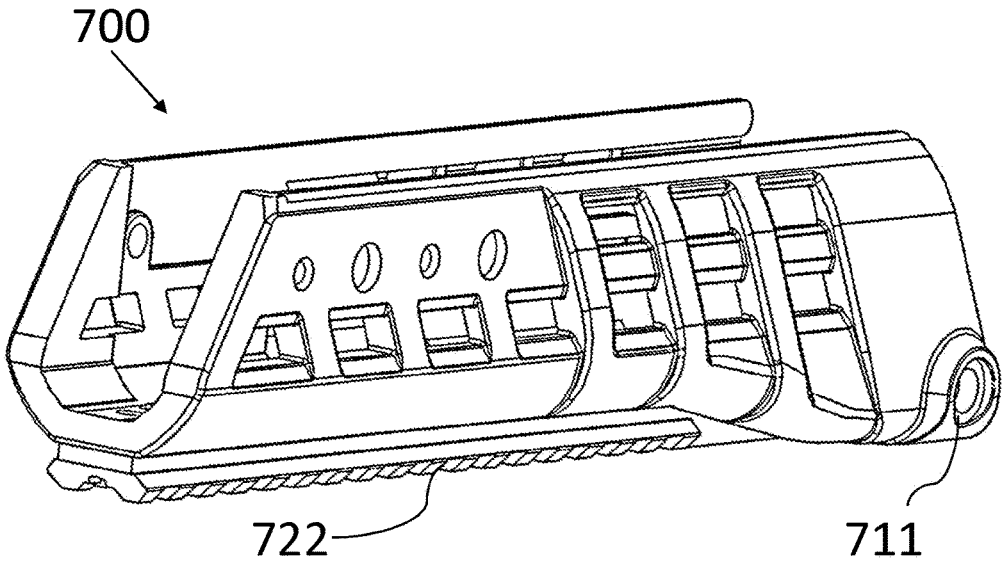
FIG. 7A schematically illustrates a perspective left-side view of the bottom handguard assembly, according to an exemplary embodiment of the invention.

Reference is now made to FIG. 7A, which schematically illustrates a perspective left-side view of the bottom handguard assembly 700, according to some embodiments of the invention. The bottom handguard assembly 700 may be assembled onto the modified rifle once the top mounting rail assembly 500 is assembled and in a locked state. The user may attach the bottom handguard assembly 700 from the bottom side of the barrel (for instance as shown in FIG. 1) in order to provide a handguard.

In some embodiments, the bottom handguard assembly 700 may comprise a handguard coupling element 711 that corresponds to the bottom coupling element 511 (for example as shown in FIG. 5F). By coupling the bottom handguard assembly 700 to the modified rifle (e.g., with a dedicated locking pin), the bottom handguard assembly 700 may be fixed to the bottom portion of the rifle.

Optionally, the bottom handguard assembly 700 may also comprise a bottom mounting rail 722 that is capable of receiving mountable attachments (e.g., a grenade launcher) that are compatible with such rails.

Figure 7B:
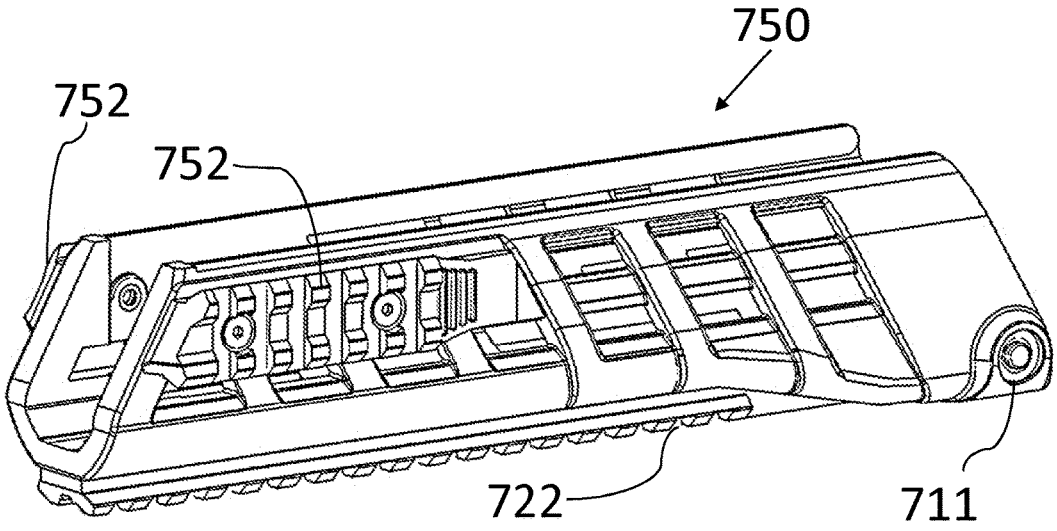
FIG. 7B schematically illustrates a perspective left-side view of the bottom handguard assembly with a frontal attachment, according to an exemplary embodiment of the invention.

Reference is now made to FIG. 7B, which schematically illustrates a perspective left-side view of the bottom handguard assembly 700 with a frontal attachment 752, generally designated 750, according to some embodiments of the invention. In order to further attach the bottom handguard assembly 700 to the rifle, at least one frontal attachment 752 may be assembled onto the bottom handguard assembly 700 in order to attach to the rifle (e.g., with dedicated screws).

It should be noted that the bottom handguard assembly 700 may easily be removed from the modified rifle once assembled (e.g., with removal of a locking pin). Thus, the modified rifle may be easily dismantled from the covers in a minimal number of operations (e.g., with 4 operations), in contrast to some commercially available rifles that require a longer operation with a larger number of steps.

Furthermore, with such configuration for the rifle, firing may still be enabled once the covers, i.e., the top mounting rail assembly and the bottom handguard assembly, are removed in contrast to some commercially available rifles (e.g., the AK-47) that require removal of the gas tube in order to remove the bottom cover, thereby preventing operation of the rifle.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

Various embodiments have been presented. Each of these embodiments may of course include features from other embodiments presented, and embodiments not specifically described may include various features described herein.

The invention claimed is:

1. An upgrade kit for an assault rifle having a rear trunnion and a barrel positioned along a longitudinal axis of the rifle, the kit comprising:

a mounting rail assembly, comprising a mounting platform that is configured to couple with rifle attachments, whereby the mounting rail assembly is adapted to provide steady and tight attachment to the barrel;

an ambidextrous charging handle assembly adapted to be installed on the right or the left side of the rifle, at substantially the same location along the longitudinal axis, the charging handle assembly comprising:

a modified bolt carrier having a perforation, and a press-fit pin;

an installation rod having a first gap, and the installation rod corresponding in shape to the perforation in the bolt carrier;

a charging handle configured to be gripped by a user;

an intermediate section having a second gap, and connected to the installation rod and to the charging handle, wherein the press-fit pin corresponds in shape to the first and second gaps, and wherein the press-fit pin is configured to removably connect the handle body to the bolt carrier, and a locking latch, configured to be gripped by the user, wherein the mounting rail assembly further comprises a rear latch, configured to removably connect to the rear trunnion, and wherein, in a locked state, the locking latch locks the mounting rail assembly to the rifle, and wherein operation of the locking latch removes the mounting rail assembly from the rifle.

2. The upgrade kit of claim 1, wherein movement of the locking latch from an open state to a locked state, snaps the locking latch onto at least one locking element, and aligns the locking latch with the barrel.

3. The upgrade kit of claim 1, wherein the mounting rail is a Picattiny rail.

4. The upgrade kit of claim 1, further comprising a handguard cover.

5. The upgrade kit of claim 4, wherein the handguard cover comprises a bottom mounting platform that is configured to couple with rifle attachments.

6. The upgrade kit of claim 1, further comprising a V-shaped attachment configured to align additional components onto the rifle, wherein the V-shaped attachment is further configured to allow contact with the barrel.

7. The upgrade kit of claim 6, wherein the V-shaped attachment further comprises at least one V-shaped notch that is configured to tightly couple with a compatible portion of the top mounting rail assembly, and wherein the V-shaped notch is further configured to align the mounting rail assembly with the barrel along the longitudinal axis.

8. A method for assembling a mounting rail assembly onto an assault rifle coupled with a locking latch, the rifle comprising a rear trunnion and a barrel positioned along a longitudinal axis of the rifle, the method comprising:

providing a mounting rail assembly, comprising:

a mounting platform that is configured to couple with rifle attachments; and a rear latch that is configured to removably connect to the rear trunnion;

positioning the mounting rail assembly onto the barrel, along the longitudinal axis, such that the rear latch faces the rear trunnion;

pushing the mounting rail assembly along the longitudinal axis, until the rear latch engages the rear trunnion and couples thereon; and moving the locking latch so as to snap at least one locking element of the rifle.

9. The method of claim 8, further comprising:

moving the locking latch so as to snap off at least one locking element of the rifle;

pushing the mounting rail assembly along the longitudinal axis, until the rear latch disengages the rear trunnion; and removing the mounting rail assembly from the rifle.

10. A modified assault rifle, comprising:

a barrel, positioned along a longitudinal axis of the rifle;

a rear trunnion;

a mounting rail assembly, comprising a mounting platform that is configured to couple with rifle attachments, whereby the mounting rail assembly is adapted to provide steady and tight attachment to the barrel;

an ambidextrous charging handle assembly adapted to be installed on the right or the left side of the rifle, at substantially the same location along the longitudinal axis, the charging handle assembly comprising:

a modified bolt carrier having a perforation, and a press-fit pin;

an installation rod having a first gap, and the installation rod corresponding in shape to the perforation in the bolt carrier;

a charging handle configured to be gripped by a user; and an intermediate section having a second gap, and connected to the installation rod and to the charging handle, wherein the press-fit pin corresponds in shape to the first and second gaps, and wherein the press-fit pin is configured to removably connect the handle body to the bolt carrier, and a locking latch, configured to be gripped by the user;

wherein the mounting rail assembly further comprises a rear latch, configured to removably connect to the rear trunnion, and wherein in a locked state the locking latch locks the mounting rail assembly to the rifle, and wherein operation of the locking latch removes the mounting rail assembly from the rifle.

11. The modified assault rifle of claim 10, wherein movement of the locking latch from an open state to a locked state, snaps the locking latch onto at least one locking element, and aligns the locking latch with the barrel.

12. The modified assault rifle of claim 10, wherein the mounting rail is a Picattiny rail.

13. The modified assault rifle of claim 10, further comprising a handguard cover.

14. The modified assault rifle of claim 13, wherein the handguard cover comprises a bottom mounting platform that is configured to couple with rifle attachments.

15. The modified assault rifle of claim 10, further comprising a V-shaped attachment configured to align additional components onto the rifle, wherein the V-shaped attachment is further configured to allow contact with the barrel.

16. The modified assault rifle of claim 15, wherein the V-shaped attachment further comprises at least one V-shaped notch that is configured to tightly couple with a compatible portion of the top mounting rail assembly, and wherein the V-shaped notch is further configured to align the mounting rail assembly with the barrel along the longitudinal axis.

* * * * *